United States Patent [19]

Hopps

[11] Patent Number: 4,957,466

[45] Date of Patent: Sep. 18, 1990

[54] ATHLETIC SUPPORTER FOR WOMEN

[76] Inventor: Trisha L. Hopps, 585 Roberts Rd., Paradise, Calif. 95969

[21] Appl. No.: 425,684

[22] Filed: Oct. 23, 1989

[51] Int. Cl.[5] ..... A41C 3/00

[52] U.S. Cl. ..... 450/85; 450/23; 450/65; 450/79; 450/80; 2/73; 2/113

[58] Field of Search ..... 2/25, 102, 105, 106, 2/107, 110, 112, 113, 114, 73, 113; 450/1, 23, 60, 63, 65, 66, 67, 79, 80, 82, 83, 84, 85, 88, 94

[56] References Cited

U.S. PATENT DOCUMENTS

| | | | |
|---|---|---|---|
| 742,928 | 11/1903 | Tabor | 2/112 |
| 1,306,595 | 6/1919 | Jerome | 2/110 |
| 1,363,038 | 12/1920 | Gottlieb | 2/110 |
| 1,510,428 | 9/1924 | Voliva | 450/58 X |
| 2,723,396 | 11/1955 | Stack | 450/58 |
| 3,204,638 | 9/1965 | Winkler | 450/80 X |
| 3,266,495 | 8/1966 | Sachs | 450/55 |
| 3,362,409 | 1/1968 | Bruno | 450/70 X |
| 3,399,678 | 9/1968 | Faron | 450/55 |
| 3,488,776 | 1/1970 | Luhr . | |
| 3,511,743 | 5/1970 | Rach | 2/2.5 X |
| 3,561,442 | 2/1971 | Goswitz | 450/1 X |
| 3,633,215 | 1/1972 | Richards . | |
| 3,698,015 | 10/1972 | Richards et al. . | |
| 3,968,803 | 7/1976 | Hyman | 450/58 |
| 4,174,717 | 11/1979 | Schreiber | 450/70 |
| 4,183,097 | 1/1980 | Mellian | 2/2.5 |
| 4,289,137 | 9/1981 | Dell et al. | 450/58 |
| 4,311,150 | 1/1982 | Schreiber et al. | 450/70 |
| 4,398,538 | 8/1983 | Johnson | 450/1 X |
| 4,538,614 | 9/1985 | Henderson | 450/70 |
| 4,557,267 | 12/1985 | Cole | 450/40 |
| 4,583,544 | 4/1986 | Flanagan et al. | 450/58 |
| 4,601,069 | 7/1986 | Fiore, Jr. et al. . | |
| 4,697,285 | 10/1987 | Sylvester | 2/2.5 |
| 4,781,651 | 11/1988 | Ekins | 450/79 |
| 4,816,005 | 3/1989 | Braaten | 450/66 X |

FOREIGN PATENT DOCUMENTS

| | | | |
|---|---|---|---|
| 0201496 | 4/1955 | Australia | 450/55 |
| 714271 | 8/1954 | United Kingdom | 450/40 |

OTHER PUBLICATIONS

Gershman, Maurice, "Self Adhering Nylon Tapes", The J.A.M.A., p. 930, vol. 168, No. 7, Oct. 1958.

*Primary Examiner*—Werner H. Schroeder
*Assistant Examiner*—Jeanette E. Chapman

[57] ABSTRACT

A sleeveless bodice type athletic support garment structured of a multi-layered rectangular front and back panel, two length adjustable shoulder straps, a neck opening, two arm apertures, and two openable side seams attachable with hook and loop fasteners to allow size adjustability. The garment is made of a resilient material capable of dissipating heat and perspiration. The interior of the front panel is affixed with a flat rectangular elastic panel to support and stabilize a woman's breasts against her chest. The athletic support garment is especially directed for use by large breasted women who require additional support during strenuous or active sports. The support garment can be worn in place of a bra, over existing clothing or even as an outer garment.

5 Claims, 5 Drawing Sheets

ATHLETIC SUPPORTER FOR WOMEN

BACKGROUND OF THE INVENTION

1. Field of the Invention:

This invention relates to support garments for the breasts of women. The present device is directed towards a bodice type garment having an internal front elastic panel designed to provide an improved breast support for women during exercise.

2. Description of the Prior Art:

Athletic bras and support garments for women have been in use for some time which are similar in structure and appearance to conventional bras. Although they may give some measure of increased support over regular bras they are still insufficient for large breasted woman participating in active sports. These existing athletic support bras are primarily designed with individual cups supported by two shoulder straps which are affixed to a back panel. When the bra, and especially the straps, are designed to be stretchable there exists too much give in the material, creating a bouncing effect. Too little give in the material and an uncomfortable compressing effect occurs. There has yet to be developed a conventional athletic bra which is sufficiently resilient to provide comfort yet firm enough to provide adequate support for large breasted women. Even when the component parts of these bras are created larger or wider to provide better support, the shoulder straps still remain the basis of the supporting structure. This results in an uncomfortable strain on a relatively narrow area of the shoulder.

Stretchable pull-over bodice garments have also been used in the past as athletic supports for women. These garments however lack the strength to provide sufficient breast support as they must remain flexible enough for pull-on application. They also lack means for circumferal adjustment.

Various bodice garments seen in past-art patents do not provide adequate support for many women athletes competing in certain strenuous or active sports. Those bodice garments which seemed most pertinent to my invention were found in the following U.S. classes and subclasses: 1/120, DIG. 6, 106, 300, 102, 115, and 105.

The following U.S. Patents were deemed most relevant to my device:

The Richards et al patent, U.S. Pat. No. 3,633,215, dated Jan. 11, 1972, shows a sleeveless, waist-length garment having openable side panels, and a sealable bottom seam useful for creating a tote bag. The garment appears to be designed for use in some form of sewing or embroidery work. The bodice is also not designed to be tight fitting and would provide very little support.

Another Richards et al patent, U.S. Pat. No. 3,698,015, dated Oct. 17, 1972, shows practically the same garment as the previous patent; a sleeveless, waist-length garment having openable side panels. The same disadvantages apply to this garment as the first.

The Fiore, Jr. et al patent issued on Jul. 22, 1986, U.S. Pat. No. 4,601,069, teaches a bare midriff garment having an elastic waist band. This garment would also not provide sufficient support for a woman.

A patent issued to Luhr on Jan. 13, 1970, U.S. Pat. No. 3,488,776, shows a slip-over stretchable bodice having an elastic waist band. Should the garment be manufactured of sufficiently heavy stretchable material a better degree of support would result. Although the heavier material may provide some extra support it would also make applying and removing the garment very difficult as there are no openable side seams or means for side adjustment for variations in size.

None of the previously mentioned garments or devices are specifically directed for use by large breasted women while participating in active sports. Also, none were found which appeared to provide the wide range of size adjustability essential to allow for a properly sized and tightened breast support garment necessary to maintain the breasts of a woman generally stationary against her chest during rigorous exercise.

SUMMARY OF THE INVENTION

In practicing my invention, I have developed a tight fitting stretchable bodice having wide adjustable shoulder straps, and two openable side seams adapted to allow size adjustability of the garment. The main supportive feature of my garment is a wide internal front elastic panel fitted between the two layers of stretchable fabric of the front panel. In use the garment can be slipped over the head with one or both side panels opened, or wrapped around the chest with one side panel open and the shoulder straps detached. Each side panel has a wide rectangular vertical section of hook and loop type fasteners which can be used to adjust the circumferal fit of the bodice. The bottom and top edge of both the front and rear panels contains a hem which encloses an elastic band. This elastic hem keeps the bottom section of the bodice from riding up or sagging open, and keeps the top of the bodice from sliding downward. An important feature of my invention is the addition of the wide elastic panel affixed to the interior edges between the two stretchable layers of the front panel. This elastic panel is sized in height to extend from the upper elastic band just above the breasts to the hemmed elastic band on the bottom edge. The extra wide elastic band is sized slightly shorter in width than the normal size allotment of each user providing an exceptionally snug fit over the breasts. This provides a much wider area of support than do conventional bras, covering all of the breast area. By providing the major support and stability for the breasts the wide elastic band helps to eliminate the downward force or strain on the shoulders usually experienced by conventional sports bras. The wide shoulder straps of the bodice also help disperse this strain.

My athletic supporter is primarily designed to be worn as an undergarment but can also be worn separately with shorts or can be worn over T-shirts or leotards. One advantage when worn over existing clothing is the fact that it eliminates the need to change from bra to athletic support garment back to bra again after use.

The athletic support bodice is provided in three or four major size ranges such as small, medium, large and extra large, with further adjustments made with the hook and loop type fasteners.

Therefore, a primary object of my invention is to provide an athletic support bodice having an elastic band designed to support and stabilize the breasts.

Another object of my invention is to provide an athletic support bodice which dissipates the downward force applied against the shoulders.

A further object of my invention is to provide an athletic support garment which provides for a wide range of size adjustments to allow a women to properly adjust the tightness of the garment for her specific needs.

An even further object of my invention is to provide an athletic support bodice which can be worn in place of a bra under clothing, or over clothing or even alone as a separate garment top or shirt.

Other objects and advantages will become apparent during the review of the remaining specification with reference to the accompanying numbered drawings.

DESCRIPTION OF THE PREFERRED EMBODIMENT

Figure 1:
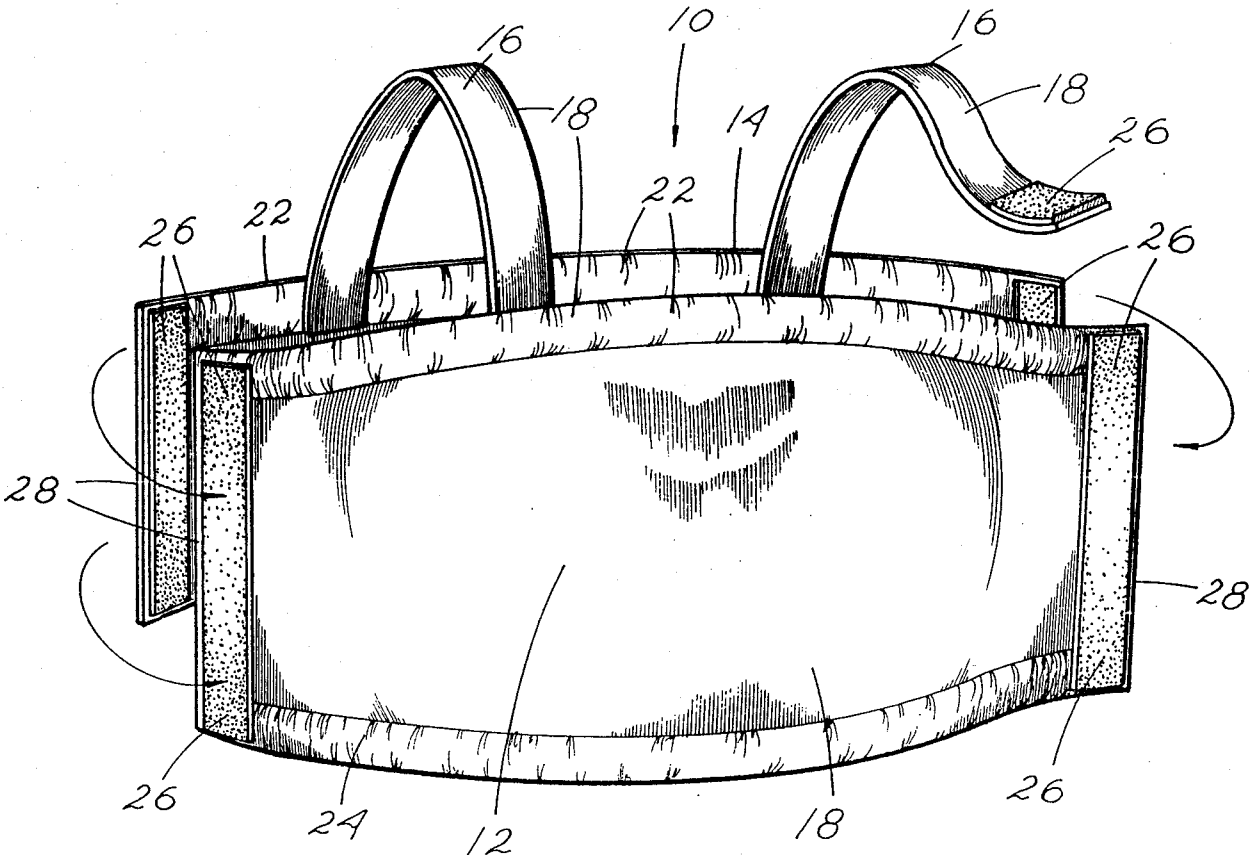
FIG. 1 is a perspective frontal view of the preferred embodiment.
Figure 2:
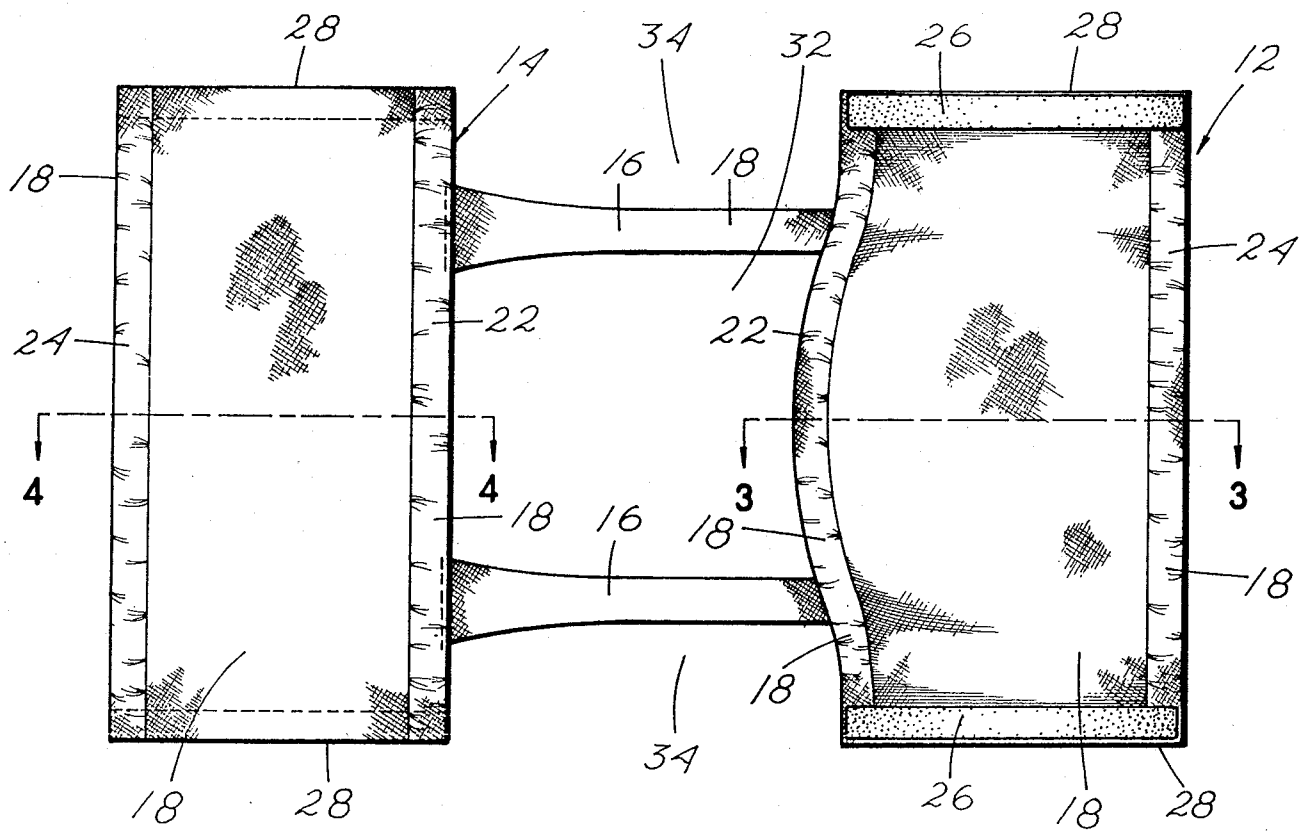
FIG. 2 is an exterior view of the preferred embodiment with the bodice opened and laid flat.
Figure 3:
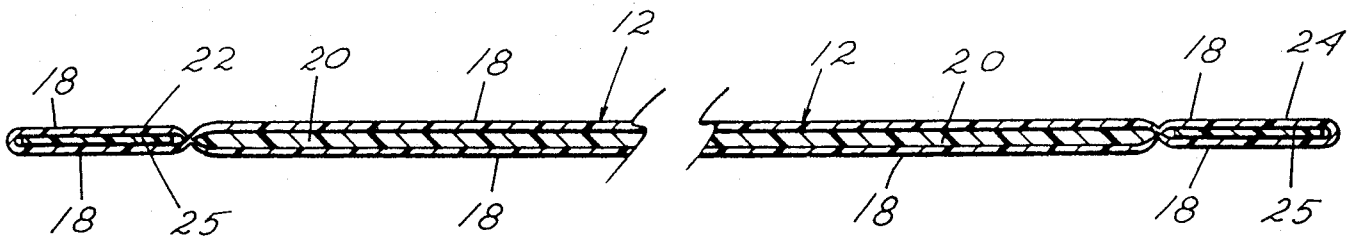
FIG. 3 is a sectioned side view of FIG. 2 of the front panel of the bodice depicting the internal elastic panel positioned between the outer layers of stretchable material. The upper and lower hemmed bands housing elastic strips are shown on the left and right, respectively.
Figure 4:
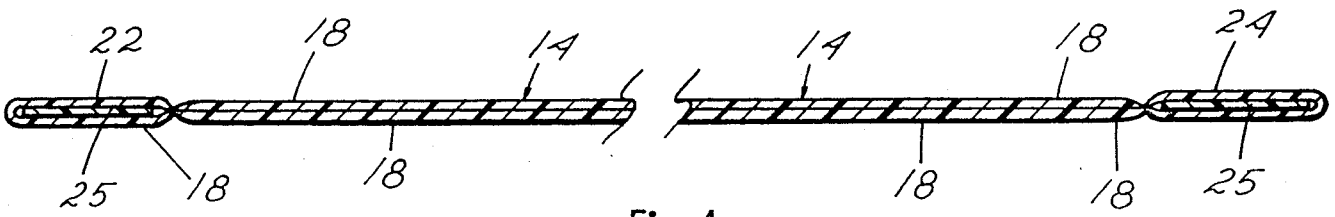
FIG. 4 is a sectioned side view of FIG. 2 of the back panel of the bodice depicting the two layers of stretchable fabric and the upper and lower elastic hems.
Figure 5:
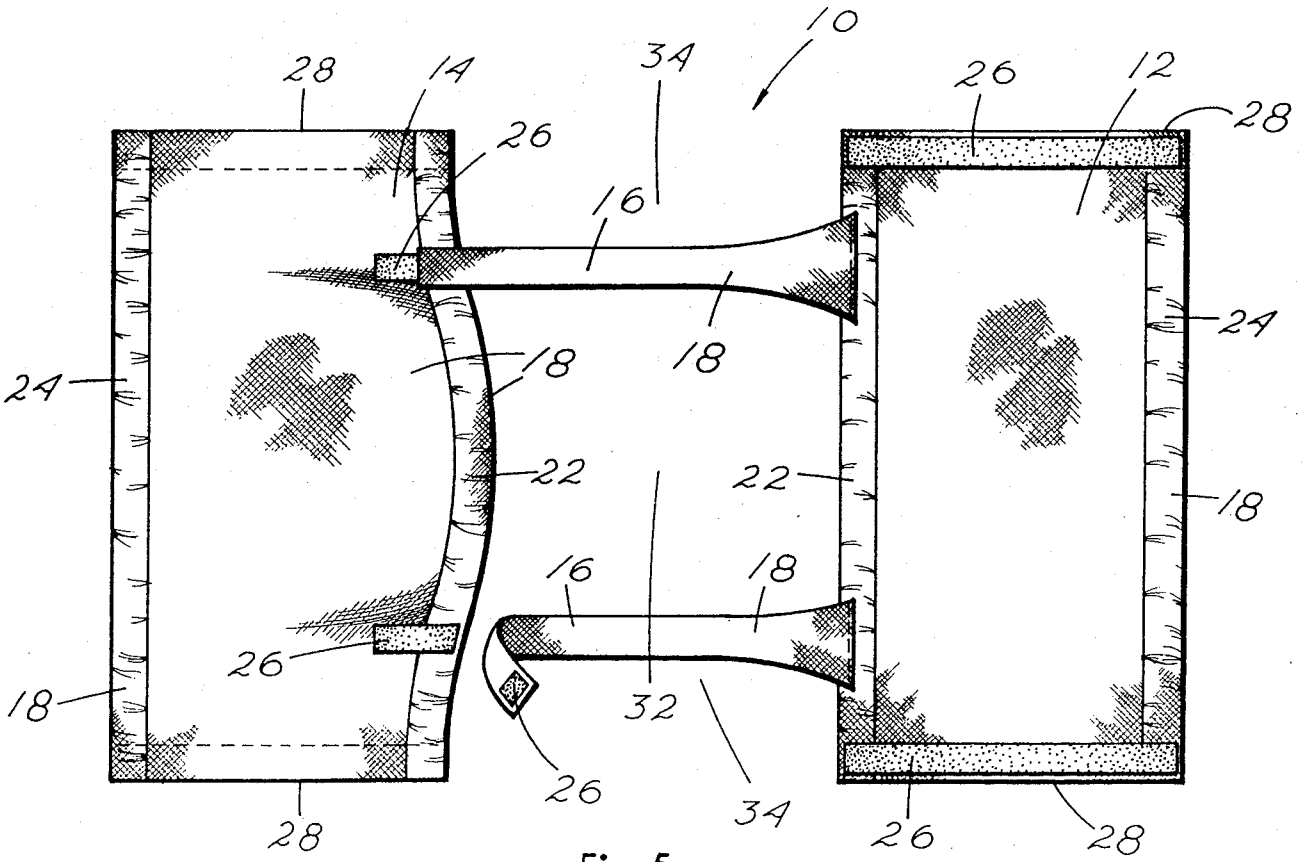
FIG. 5 is an interior or rear view of the bodice with the side seams or edges unattached and the panels laid flat. The hook and loop fasteners are shown affixed to the inside upper edge of the front panel and the distal ends of the shoulder straps.
Figure 6:
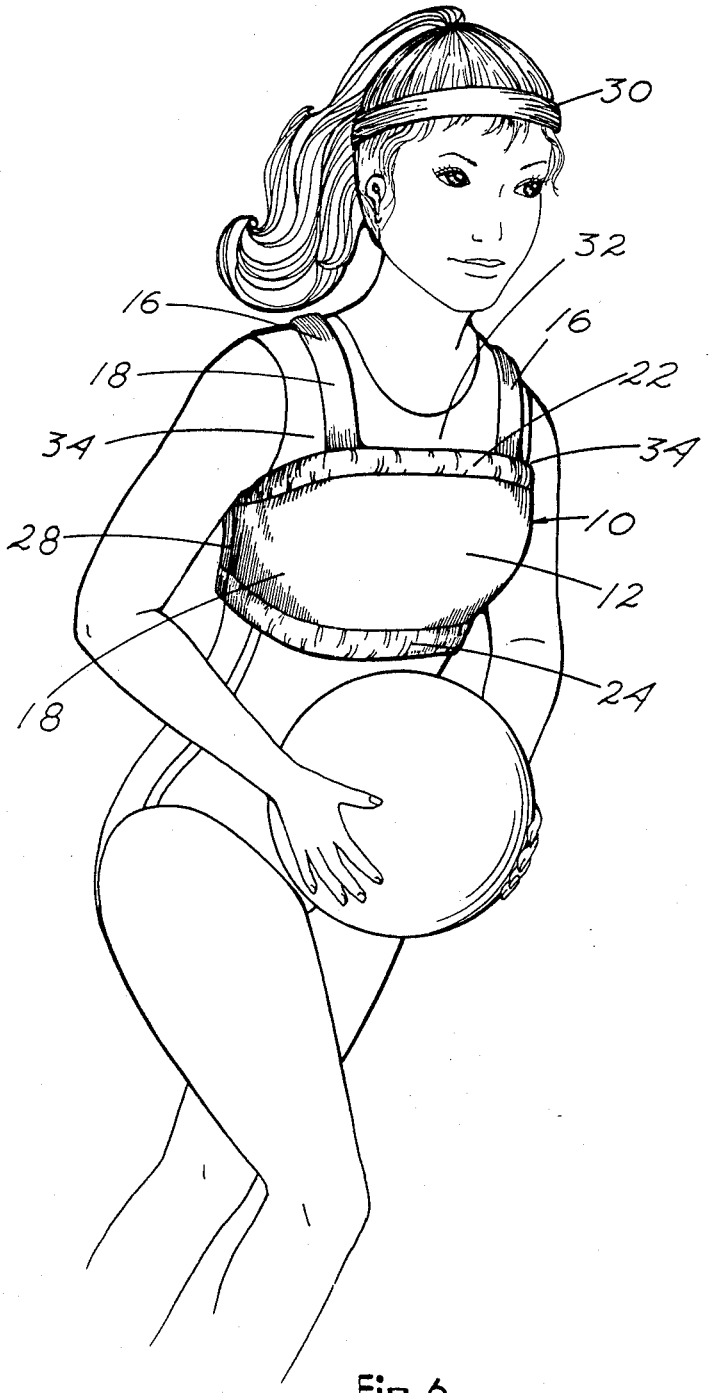
FIG. 6 is an in-use illustration showing the preferred embodiment being worn by a user participating in athletics.

Referring now to the drawings and to FIG. 1 where the preferred embodiment is illustrated. The preferred embodiment or bodice 10 comprises one front panel 12, one back panel 14 and two adjustable shoulder straps 16. Front panel 12 is comprised of two outer layers of stretchable material 18, having an inner layer made up of elastic panel 20. Once the several layers of front panel 12 are assembled they function as a single unit and will be referred to as front panel 12 collectively. Elastic panel 20 is a strong yet lightweight band of elastic of the same size and shape as front panel 12. The upper edge of front panel 12 is affixed to an upper hemmed elastic band 22 and the lower edge is affixed with hemmed elastic waistband 24, both containing elastic strip 25. Back panel 14 is also constructed of two layers of stretchable material 18 but without the inner layer of elastic panel 20. Both layers of back panel 14, once assembled, also function as a single unit and will be referred to as back panel 14 collectively. The upper edge of back panel 14 is affixed with upper hemmed elastic band 22 and the lower edge is affixed with hemmed elastic waistband 24. Upper hemmed elastic band 22 and hemmed elastic waistband 24 are very resilient and help to maintain bodice 10 in position, preventing the garment from riding up or sliding downward. Elastic strip 25 contained in both hems constricts slightly tighter than stretchable material 18 and elastic panel 20, providing an exceptionally secure fit. The front side edges of front panel 12, are affixed with elongated vertical rectangular sections of hook and loop fasteners 26, which overlap and affix to matching sections of hook and loop fasteners 26 affixed to the interior side edges of back panel 14. Both side edges of front panel 12 and back panel 14 are referred to as openable side seams 28. The coarser looped section of hook and looped fasteners 26 are positioned on front panel 12 away from user's 30 skin. Shoulder straps 16 are wide elongated straps of stretchable material 18 affixed endwardly to the top edge of back panel 14. The opposite distal ends are affixed with small sections of hook and loop fasteners 26 which are releasably affixed to matching sections of hook and loop fasteners 26 located on the interior surface of front panel 12, as seen in FIG. 5. The section of hook and loop fasteners 26 affixed to the interior surface of front panel 12 are longer in length than those affixed to the distal end of shoulder straps 16 and allow a greater degree of adjustability. The coarser section of hook and loop fastener 26 is also affixed to the distal end of shoulder strap 16 away from user's 30 skin. The area between shoulder straps 16 and the top edge of front panel 12 and back panel 14 is referred to as neck opening 32, and the area just above openable side seams 28 and adjacent shoulder straps 16 is designated as arm openings 34.

In use, bodice 10 can be applied by passing neck opening 32 over the head of user 30 with front panel 12 positioned forward and one or both openable side seams 28 unattached. User's 30 head is passed through neck opening 32 with both arms passing through arm openings 34. Each openable side seam 28 is then affixed by overlapping the edge of back panel 14 onto the outer edge of front panel 12, connecting hook and loop fasteners 26. Another application method can be used where one openable side seam 28 is unattached and both shoulder straps 16 are unattached with front panel 12 and back panel 14 wrapped around user's 30 chest area. Side seam 28 is then attached along with both shoulder straps 16.

Once in place, further fitting adjustments can be made in bodice 10 by readjustment of shoulder straps 16 and side seams 28. Front panel 12 is designed to be shorter in width than user's 30 chest area to provide an exceptionally snug fit when both side seams 28 are attached. Elastic panel 20 must be stretched over user's 30 breasts and maintained in an extended position to provide the necessary support. One significant feature of hook and loop fasteners 26 is that they are sized wider than is necessary for regular attachment. This allows a measure of adjustability of the circumferal fit of the garment, and for the length of shoulder straps 16. By barely overlapping the edges of openable side seams 28 a larger circumference is made. By over-extending the overlapping of side seams 28, a tighter fit is made. When in use, elastic panel 20 is positioned entirely over the breasts of user 30 reaching from just below neck opening 32 to just beneath the breasts. By concentrating the supporting force on elastic panel 20 alone, front panel 12 and back panel 14, along with hemmed elastic waistband 24 and upper hemmed elastic band 22, are left to be less restrictive to user 30. In other words, the entire garment could have been manufactured of the same heavy elastic material as elastic panel 20 and the same support and stability would have been achieved. However, this would prove to be unduly constrictive and uncomfortable to user 30. Stretchable material 18 is specially structured to promote improved air circulation and dissipate perspiration creating a garment which is much more comfortable than an entire garment made with heavy elastic material such as elastic panel 20. One such brand of the special permeable material is Lycra, and another is the composite fabric for sportswear developed by Lawrence Kuznetz, with which he received U.S. Pat. No. 4,501,025 in Feb. 26, 1985. Although these specialty fabrics are designed for greater comfort they generally are not designed for strength and support which is needed for an athletic garment, and therefore would not be effective without the addition of elastic panel 20. The assemblage of the component parts of bodice 10 can be done with conventional sewing means, with adhesives or some form of heat bonding, as long as the garment retains the necessary resiliency.

Although bodice 10 is suggested as an undergarment in place of a conventional bra, it can also be worn over the bra and or lightweight clothing, or even worn as the outer garment itself. Various sizes of bodice 10 can also be provided to ensure a more proportionate fit.

Although my invention has been described in detail in the specification, it is to be understood that such descriptions are merely illustrative of the principles of the invention, and are not meant to limit the scope of the invention beyond that of the appended claims.

What I claim as my invention is:

1. An athletic supporter for women adapted by pattern to be worn as an upper body covering and by structure to prevent excessive breast movement during active participation in sports, said supporter comprising in combination:

a front panel;

said front panel adapted to supportively cover and contour to a female breast shape by resilience in a thickened elastic filling sandwiched between encasing walls of a stretchable covering material;

said covering material having permeative qualities for transferring sweat and heat away from a wearer's body;

a back panel;

said back panel adapted to contour to the back shape of a human wearer by elasticity in materials forming a double wall thereof;

said double wall of said back panel having permeative qualities for transferring sweat and heat away from a wearer's body;

means for attaching said front panel to said back panel adjustably sized relative to said wearer's requirements;

means for maintaining said supporter adjustably in a breast supporting and covering positioned relative to said wearer's shoulders with said front panel providing said breast supporting and covering and said back panel fitted to the back of said wearer;

means providing for tighter containment of an upper portion and of a lower portion of both said panels relative to breast size and body measurements of said wearer.

2. The athletic supporter for women as defined in claim 1 wherein said means for maintaining said supporter adjustably in a breast supporting and covering positioned relative to said wearer's shoulders includes attachments affixed to said supporter for hanging said supporter from said wearer's shoulders with at least one position on each of said attachments being releasable and adjustably re-attachable.

3. The athletic supporter for women as defined in claim 1 wherein said means for attaching said front panel to said back panel adjustably sized relative to said wearer's requirements includes, as at least one of said means thereof, hook and loop fasteners.

4. The athletic supporter for women as defined in claim 1 wherein said material having permeative qualities for transferring sweat and heat away from a wearer's body is any suitable commercially available permeable material strengthened by structuring of said supporter.

5. The athletic supporter for women as defined in claim 1 wherein said means providing for tighter containment of an upper portion and of a lower portion of both said panels relative to breast size and body measurements of said wearer includes as one of said means, elastic strips in said upper portions and said lower portions of both said panels.

* * * * *